US005600306A

United States Patent [19]

Ichikawa et al.

[11] Patent Number: 5,600,306

[45] Date of Patent: Feb. 4, 1997

[54] RECEPTACLE UNIT AND EXTENSION CORD

[75] Inventors: Minoru Ichikawa, Tokyo; Teruhiko Ishinaka, Okegawa, both of Japan

[73] Assignee: Nisso Industry Co., Ltd., Tokyo, Japan

[21] Appl. No.: 542,319

[22] Filed: Oct. 12, 1995

[30] Foreign Application Priority Data

Oct. 17, 1994 [JP] Japan ..... 6-275511
Feb. 1, 1995 [JP] Japan ..... 7-034724

[51] Int. Cl.[6] ..... G08B 21/00

[52] U.S. Cl. ..... 340/584; 337/1; 340/595; 340/596; 340/650; 361/93; 361/102; 361/103

[58] Field of Search ..... 340/584, 595, 340/596, 650; 361/103, 93, 102; 337/1

[56] References Cited

U.S. PATENT DOCUMENTS

| | | | |
|---|---|---|---|
| 3,320,601 | 5/1967 | Yankus | 348/594 |
| 3,872,355 | 3/1973 | Klein et al. | 361/45 |
| 4,118,690 | 10/1978 | Paynton | 340/635 |
| 4,771,367 | 9/1988 | Serr et al. | 361/102 |
| 4,903,162 | 2/1990 | Kopelman | 361/103 |
| 4,951,025 | 8/1990 | Finnegan et al. | 337/113 |
| 4,979,070 | 12/1990 | Bodkin | 340/650 |
| 5,188,542 | 2/1993 | Ballman | 439/620 |

FOREIGN PATENT DOCUMENTS

| | | |
|---|---|---|
| 0338101 | 10/1989 | European Pat. Off. . |
| 2620873 | 12/1976 | Germany . |
| 4036665 | 5/1991 | Germany . |

*Primary Examiner*—Glen Swann
*Attorney, Agent, or Firm*—Oblon, Spivak, McClelland, Maier & Neustadt, P.C.

[57] ABSTRACT

An electrical receptacle unit includes at least one receptacle body (3) internally provided with a pair of slotted terminals (4) for insertion of a pair of blades (L) of a load-side electrical plug (P), a thermistor (7) encased in a protective tube (9) outwardly projectable from between the slotted terminals (4) of the receptacle body (3), a coil spring (13) for projecting the thermistor (7) out from the receptacle body (3), a relay (14) for enabling and disabling supply of electric power to the slotted terminals (4), a control circuit (19) which operates the relay (14) to cut off supply of electric power to the slotted terminals (4) when the temperature of the thermistor (7) reaches or exceeds a preset temperature, and a buzzer (23) operated by an output signal produced by the control circuit (19) when the temperature of the thermistor (7) reaches or exceeds the preset temperature. When the thermistor rises to or above the preset temperature owing to tracking or the like, supply of power to the load-side plug is cut off and the alarm is activated to produce a warning that the load-side plug has overheated.

33 Claims, 9 Drawing Sheets

RECEPTACLE UNIT AND EXTENSION CORD

BACKGROUND OF THE INVENTION

1. Field of the Invention

This invention relates to an electrical receptacle unit which senses the temperature of the contact portion between itself and any of various types of electrical plugs, such as the plug of an aquarium illumination device, and outputs a corresponding temperature signal in response to which the supply of electrical power to devices connected with the plug is shut off, and to an electrical extension cord.

2. Description of the Prior Art

Since an overheated electrical plug is a fire hazard, some plugs are equipped with a safety device for shutting off the supply of power from the plug to the associated electrical device when plug temperature rises above the rated level.

For example, Japanese Utility Model Public Disclosure Hei 4-118581 teaches a safety device of this type equipped with a temperature rise preventer which operates to cut off the supply of electric power from a plug when the temperature inside the plug becomes abnormally high owing to poor contact between the plug blades and the slotted terminals of the receptacle into which it is inserted. The device can thus prevent the plug from overheating and starting a fire.

In the prior-art safety devices, the temperature rise preventer for detecting increase in plug temperature during power supply and cutting off the supply of power from the plug when the detected temperature rises over a preset temperature is built into the interior of the plug. However, since electrical plugs are generally small and have little interior space, the inclusion of the temperature rise prevention device is difficult and leads to a complicated configuration.

Another disadvantage of the prior-art devices is that they are unable to detect overheating of the plug or its receptacle caused by the tracking (i.e., the formation of electrically conductive paths on an insulator by electric discharge or leakage) that progressively accumulates on the insulator material of the plug or the receptacle.

The present invention was accomplished for overcoming these shortcomings of the prior art and has as its object to provide an electrical receptacle unit that has adequate space for a built-in temperature sensor, can reliably detect the temperature of a plug inserted therein, cuts off the supply of electric power to the inserted plug when the temperature rises above a preset level owing to tracking or the like, and produces a warning by activating an alarm when the temperature of the inserted plug exceeds the preset temperature.

SUMMARY OF THE INVENTION

The electrical receptacle unit according to one aspect of the present invention comprises at least one receptacle body internally provided with a pair of slotted terminals for insertion of a pair of blades of a load-side electrical plug, a temperature sensor outwardly projectable from between the slotted terminals of the receptacle body, and an energizing member for projecting the temperature sensor out from the receptacle body.

The electrical receptacle unit can be provided with a source-side plug for insertion into an electric power source receptacle or can be supplied with electric power by direct connection with electric wiring in the building in which it is used.

The electrical receptacle unit preferably comprises a switching circuit for enabling and disabling supply of electric power to the slotted terminals and a control circuit responsive to a temperature signal from the temperature sensor for operating the switching circuit to cut off supply of electric power to the slotted terminals when the temperature signal indicates a temperature equal to or higher than a preset temperature.

The electrical receptacle unit preferably comprises reset means for terminating the operation of the control circuit and an alarm which operates in response to a signal produced by the control circuit when the temperature signal from the temperature sensor is equal to or higher than the preset temperature.

The electrical receptacle unit preferably comprises a short current detector which sends a short signal to the control circuit in response to the detection of short current in a circuit powered through the load-side electrical plug inserted in the receptacle body. In this case, the control circuit is configured to be responsive to the short signal for operating the switching circuit to cut off supply of electric power to the slotted terminals and also operates the alarm.

The electrical receptacle unit according to another aspect of the invention comprises a source-side electrical plug having a plug case and a pair of blades projecting from the plug case for insertion into a pair of slotted terminals of an electric power source receptacle, a first temperature sensor provided in the plug case for detecting temperature between the blades, at least one receptacle body internally provided with a pair of slotted terminals for insertion of a pair of blades of a load-side electrical plug, the receptacle body being connected to the source-side electrical plug through a cord, a second temperature sensor outwardly projectable from between the slotted terminals of the receptacle body, and an energizing member for projecting the second temperature sensor out from the receptacle body.

The electrical receptacle unit can further comprise an energizing member for projecting the first temperature sensor out from between the blades of the source-side electrical plug and the source-side electrical plug can be formed integrally with the receptacle body.

The electrical receptacle unit preferably comprises a switching circuit for enabling and disabling supply of electric power to the slotted terminals and a control circuit responsive to a first temperature signal from the first temperature sensor and to a second temperature signal from the second temperature sensor for operating the switching circuit to cut off supply of electric power to the slotted terminals when the first temperature signal indicates a temperature equal to or higher than a first preset temperature or the second temperature signal indicates a temperature equal to or higher than a second preset temperature.

The electrical receptacle unit preferably comprises reset means for terminating the operation of the control circuit and an alarm which operates in response to an output signal produced by the control circuit when the first temperature signal indicates a temperature equal to or higher than the first preset temperature or the second temperature signal indicates a temperature equal to or higher than the second preset temperature.

The electrical receptacle unit preferably comprises a short current detector which sends a short signal to the control circuit in response to the detection of short current in a circuit powered through the load-side electrical plug inserted in the receptacle body. In this case, the control circuit is configured to be responsive to the short signal for operating the switching circuit to cut off supply of electric power to the slotted terminals and also operates the alarm.

The electrical receptacle unit according to another aspect of the invention comprises at least one receptacle body internally provided with a pair of slotted terminals for insertion of a pair of blades of a load-side electrical plug and temperature signal relay means for relaying a temperature signal supplied through the load-side electrical plug, a switching circuit for enabling and disabling supply of electric power to the slotted terminals, and a control circuit responsive to a temperature signal supplied through the temperature signal relay means for operating the switching circuit to cut off supply of electric power to the slotted terminals when the temperature signal indicates a temperature equal to or higher than a preset temperature.

The electrical receptacle unit preferably comprises a temperature sensor outwardly projectable from between the slotted terminals of the receptacle body and an energizing member for projecting the temperature sensor out from the receptacle body. In this case, the control circuit is configured to be responsive to a temperature signal from the temperature sensor indicating a temperature equal to or higher than a preset temperature for operating the switching circuit to cut off supply of electric power to the slotted terminals.

The electrical receptacle unit can be provided with a source-side plug for insertion into an electric power source receptacle or can be supplied with electric power by direct connection with electric wiring in the building in which it is used. It also preferably comprises reset means for terminating the operation of the control circuit and an alarm which operates in response to a signal produced by the control circuit when the temperature signal from the temperature sensor is equal to or higher than the preset temperature.

The electrical receptacle unit preferably comprises a short current detector which sends a short signal to the control circuit in response to the detection of short current in a circuit powered through the load-side electrical plug inserted in the receptacle body. In this case, the control circuit is configured to be responsive to the short signal for operating the switching circuit to cut off supply of electric power to the slotted terminals and also operates the alarm.

The electrical receptacle unit according to another aspect of the invention comprises a source-side electrical plug having a plug case and a pair of blades projecting from the plug case for insertion into a pair of slotted terminals of an electric power source receptacle, a first temperature sensor provided in the plug case for detecting temperature between the blades, at least one receptacle body internally provided with a pair of slotted terminals for insertion of a pair of blades of a load-side electrical plug and temperature signal relay means for relaying a temperature signal supplied through the load-side electrical plug, the receptacle body being connected to the source-side electrical plug through a cord, a switching circuit for enabling and disabling supply of electric power to the slotted terminals, and a control circuit responsive to a first temperature signal from the first temperature sensor and to a second temperature signal supplied through the temperature signal relay means for operating the switching circuit to cut off supply of electric power to the slotted terminals when the first temperature signal indicates a temperature equal to or higher than a first preset temperature or the second temperature signal indicates a temperature equal to or higher than a second preset temperature which is lower than the first preset temperature.

The electrical receptacle preferably comprises an energizing member for projecting the first temperature sensor out from between the blades of the source-side electrical plug. It also preferably comprises a second temperature sensor outwardly projectable from between the slotted terminals of the receptacle body and an energizing member for projecting the second temperature sensor out from the receptacle body. In this case, the control circuit is configured to be responsive to a third temperature signal from the second temperature sensor for operating the switching circuit to cut off supply of electric power to the slotted terminals when the third temperature signal indicates a temperature equal to or higher than the second preset temperature.

The electrical receptacle unit preferably has its source-side electrical plug formed integrally with the receptacle body and preferably comprises reset means for terminating the operation of the control circuit and an alarm which operates in response to an output signal produced by the control circuit when the first temperature signal indicates a temperature equal to or higher than the first preset temperature or the second or third temperature signal indicates a temperature equal to or higher than the second preset temperature.

The electrical receptacle unit preferably comprises a short current detector which sends a short signal to the control circuit in response to the detection of short current in a circuit powered through the load-side electrical plug inserted in the receptacle body. In this case, the control circuit is responsive to the short signal for operating the switching circuit to cut off supply of electric power to the slotted terminals and also operates the alarm.

The electrical extension cord according to this invention comprises an extension plug having a pair of blades for insertion into slotted terminals of a receptacle body of an electrical receptacle unit according to the invention and temperature signal relay means for contacting with temperature signal relay means of the receptacle body; an extension receptacle having a pair of slotted terminals, a temperature sensor outwardly projectable from between the slotted terminals and an energizing member for projecting the temperature sensor out from the extension receptacle; power wires connecting the slotted terminals of the extension receptacle to the blades of the extension plug, and signal wires connecting the temperature sensor to the temperature signal relay means.

The above and other features of the present invention will become apparent from the following description made with reference to the drawings.

BRIEF EXPLANATION OF THE DRAWINGS

FIG. 5(*b*) is a perspective view of the receptacle unit of FIG. 5(*a*) seen from the side of its slotted terminals.

DESCRIPTION OF THE PREFERRED EMBODIMENTS

The invention will now be explained with reference to embodiments thereof illustrated in the attached drawings.

Figure 1:
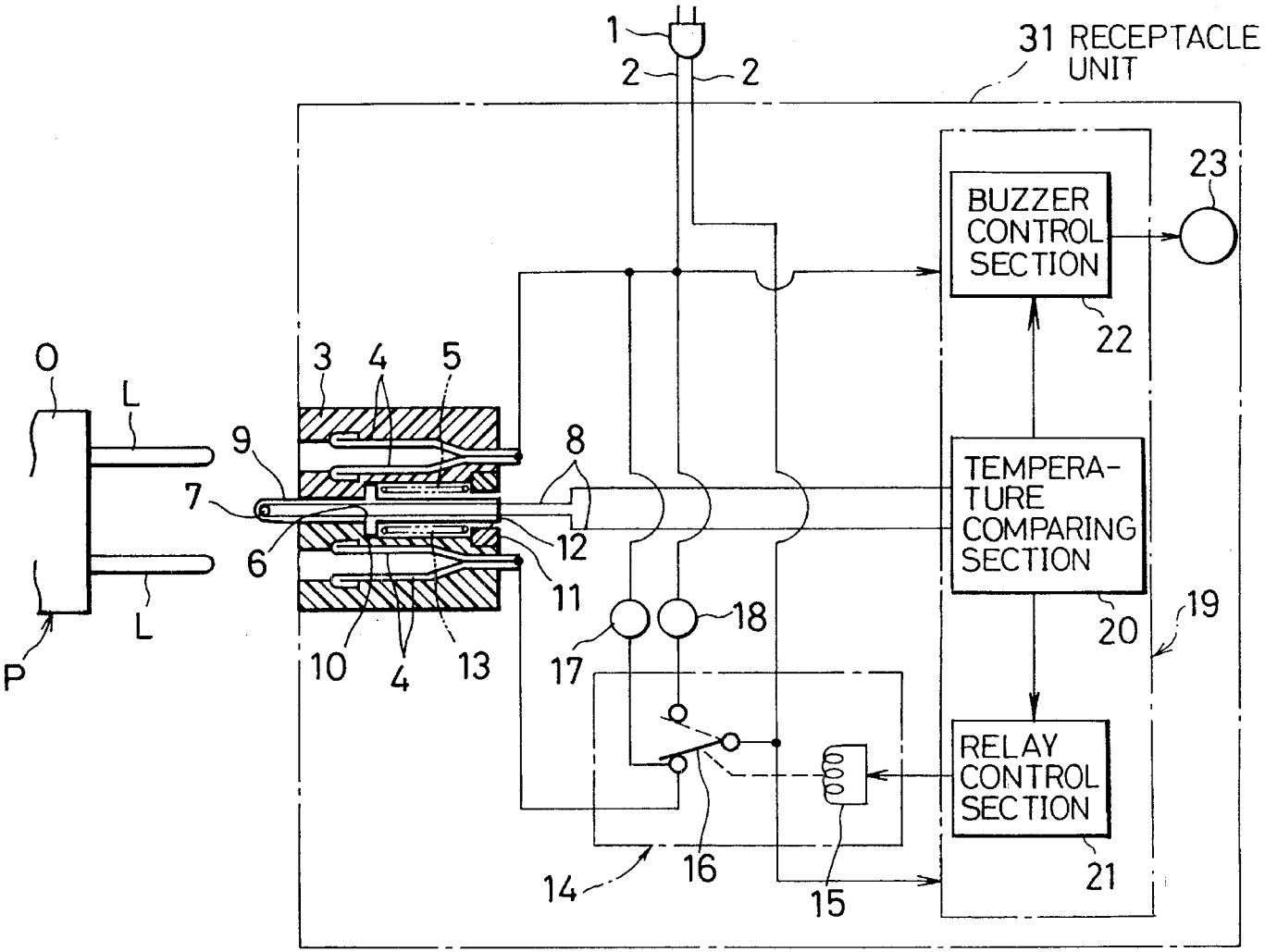
FIG. 1 is a schematic diagram showing the configuration of a receptacle unit according to a first aspect of the invention.

FIG. 1 is a schematic diagram showing the configuration of a receptacle unit 31 according to a first aspect of the invention. Although the receptacle unit 31 is equipped with four receptacle bodies for insertion of four load-side electrical plugs P, in the interest of simplicity only one is illustrated in the drawing.

In this figure, reference numeral 1 designates a source-side electrical plug which is connected to slotted terminals 4 and a control circuit 19 (both explained later) through a cord 2.

Reference numeral 3 designates a receptacle body 3 which is made of a resin that is an electrical insulator and houses a pair of slotted terminals 4 for receiving a pair of blades L projecting from a plug case O (made of a similar material) of a load-side plug P. The receptacle body 3 is formed between the slotted terminals 4 with a through hole 5 having a step 6, and a protective tube 9 encasing a thermistor 7 (explained later) is disposed in the through hole 5 with a flange 10 thereof abutting on the step 6.

The thermistor 7, which serves as a temperature sensor, is connected to a temperature comparing section 20 of the control circuit 19 by lead wires 8.

The protective tube 9 in which the thermistor 7 is sealed is made of an insulator material and has the flange 10 for abutting on the step 6 of the through hole 5.

Reference numeral 11 designates a stop which is fixed by welding or screw engagement in the rear end of the through hole 5 of the receptacle body 3. The stop 11 has a central through hole 12 through which the protective tube 9 can advance and retreat.

A coil spring 13 is inserted between the flange 10 of the protective tube 9 and the stop 11 as a biasing member for pressing the flange 10 in contact with the step 6 of the through hole 5. When the flange 10 of the protective tube 9 is in contact with the step 6 of the through hole 5, the tip of the protective tube 9 projects about 7 mm out of the receptacle body 3.

The armature 16 of a relay 14 serving as a switching circuit is positioned to supply power from the plug 1 to the slotted terminals 4 when no current is passing through a coil 15 and switches to cut off the supply of power from the plug 1 to the slotted terminals 4 when current is passed through the coil 15.

A green lamp 17 lights to indicate normal operation when power is being supplied from the plug 1 to the slotted terminals 4. The green lamp 17 goes off and a red lamp 18 lights to indicate abnormal operation when the supply of power from the plug 1 to the slotted terminals 4 is cut off.

The control circuit 19 comprises the temperature comparing section 20, a relay control section 21 and a buzzer control section 22. The temperature comparing section 20 compares the temperature detected by the thermistor 7 with a preset temperature, e.g., 100° C., and outputs a normal temperature signal or an abnormal temperature signal depending on whether or not the detected temperature is below the preset temperature. The relay control section 21 responds to an abnormal temperature signal from the temperature comparing section 20 by energizing the coil 15 of the relay 14. The buzzer control section 22 responds to an abnormal temperature signal from the temperature comparing section 20 by activating a buzzer 23 serving as an alarm.

Figure 2:
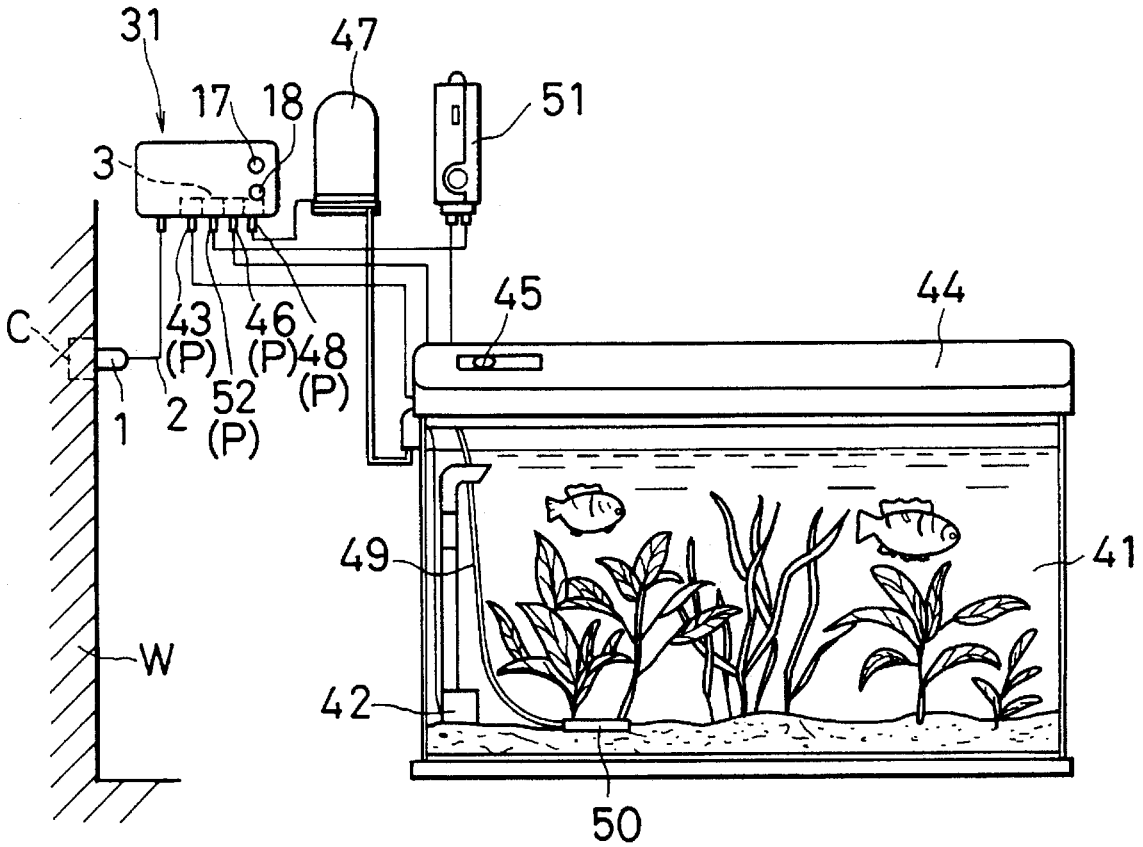
FIG. 2 is an explanatory view showing the receptacle unit according to the first aspect of the invention in use.

FIG. 2 is an explanatory view showing the receptacle unit 31 according to the first aspect of the invention in use. Members designated by the same reference symbols as those in FIG. 1 are the same as those in FIG. 1 and will not be explained again.

Since the receptacle unit 31 shown in FIG. 2 is adapted for insertion of four load-side plugs P, it is equipped with four of the receptacle bodies 3 shown in FIG. 1, each having a pair of slotted terminals 4 and a thermistor 7 encased in a protective tube 9.

The source-side plug 1 connected with the receptacle unit 31 through the cord 2 is plugged into a wall outlet C installed in a wall W.

Reference numeral 41 designates an aquarium which contains water, pebbles, water plants and the like and is stocked with various types of fish such as gold fish, tropical fish and the like.

The aquarium 41 is equipped with a filter 42 having a built in pump connected with a plug 43 (load-side plug P) through a cord. The plug 43 is inserted into a receptacle body 3 of the receptacle unit 31 to power the pump for circulating and filtering the water in the aquarium 41.

An illumination device 44 fitted with a fluorescent lamp or the like is mounted on the top of the aquarium 41 for illuminating the interior of the aquarium 41. It has a plug 46 (P) which is plugged into another receptacle body 3 of the receptacle unit 31 and a switch 45 at its upper portion for turning the fluorescent lamp on and off.

The aquarium 41 is further equipped with an air pump 47 whose plug 48 (P) is inserted into another receptacle body 3 of the receptacle unit 31. The air pump 47 pumps air through a pipe 49 to an air stone 50 where it forms into bubbles that promote the dissolving of air into the water.

A temperature controller 51 whose plug 52 (P) is inserted into another receptacle body 3 of the receptacle unit 31 regulates the temperature of the water in the aquarium 41 by controlling a heater (not shown) installed at the bottom of the aquarium 41.

The plugs 43, 46, 48 and 52 are configured in the same manner as the load-side electrical plug P described earlier.

The operation of the arrangement will now be explained.

Once the source-side plug 1 has been plugged into wall outlet C and the load-side plugs 43, 46, 48 and 52 have been inserted into the receptacle bodies 3 of the receptacle unit 31 as shown in FIG. 2, the filter 42, air pump 47 and temperature controller 51 begin to operate. Then when switch 45 is put in the ON position, the illumination device 44 comes on to illuminate the fish and the like inside the aquarium 41.

As explained earlier with reference to FIG. 1, a thermistor 7 encased in a protective tube 9 projects from each receptacle body 3. When each of the plugs 43, 46, 48, 52 is inserted into a receptacle body 3, therefore, it presses the associated protective tube 9 inward against the force of the coil spring 13 as its blades L move deeper into the slotted terminals 4. As a result, the protective tube 9 retreats with its tip maintaining contact with the portion of the plug P between the blades L.

If during the supply of power from the wall outlet C through the receptacle unit 31 to the different devices, the temperature of each of the plugs 43, 46, 48 and 52 at the portion of contact with the receptacle unit 31 remains below the preset temperature of the temperature comparing section 20, the temperature detected by the thermistor 7 in the protective tube 9 also stays below the preset temperature and the temperature comparing section 20 outputs a normal temperature signal. Since the relay control section 21 therefore does not energize the coil 15, the armature 16 remains in position of the solid line in FIG. 1 and the green lamp 17 stays lit.

Thus the fact that the green lamp 17 is lit means that the temperatures of the plugs 43, 46, 48 and 52 at the portions in contact with the receptacle bodies 3 of the receptacle unit 31 are below the preset temperature of the temperature comparing section 20.

If after the green lamp 17 has been on for some time the temperature of the contact portion between the plug 46, for example, and the receptacle body 3 into which it is plugged should rise and reach or exceed the preset temperature of the temperature comparing section 20 owing to the occurrence of tracking at this portion or to overload, the temperature detected by the thermistor 7 also reaches or exceeds the preset temperature. Since the temperature comparing section 20 therefore outputs an abnormal temperature signal, the relay control section 21 energizes the coil 15 and cause the armature 16 to switch to the position of the dashed line in FIG. 1.

As a result, the supply of power to the load-side plugs 43, 46, 48 and 52 is cut off and the red lamp 18 lights to indicate that the temperature of the contact portion between at least one plug and associated receptacle body 3 of the receptacle unit 31 has reached or exceeded the preset temperature of the temperature comparing section 20.

Since the buzzer control section 22 is also supplied with the abnormal temperature signal, it activates the buzzer 23 to issue a warning that the temperature of the contact portion between at least one plug and the receptacle unit 31 has reached or exceeded the preset temperature of the temperature comparing section 20.

Since according to the first aspect of the invention the thermistors 7 encased in the protective tubes 9 are disposed in the receptacle bodies 3 of the receptacle unit 31, adequate space is available for its provision.

In addition, each thermistor 7 is protected from damage by the protective tube 9 encasing it.

Further, the temperature of each plug P can be reliably detected even if the blades L are not fully inserted since the coil spring 13 projects the protective tube 9 out from the receptacle body 3 so as to ensure that the thermistor 7 is kept substantially in contact with the plug P as separated therefrom only by the protective tube 9.

When the temperature rises to or above the preset temperature of the temperature comparing section 20 because of tracking or overload, moreover, the control circuit 19 operates the relay 14 to cut off the supply of power to the plugs P and sounds the buzzer 23 as a warning that the contact portion between at least one plug P and the associated receptacle body 3 of the receptacle unit 31 has reached or exceeded the preset temperature.

Therefore when the temperature of the contact portion between a receptacle body 3 and a plug P reaches or exceeds the preset temperature owing to tracking or overload, the user can alerted of the need to take appropriate corrective action and the plug P can be prevented from burning.

Figure 3:
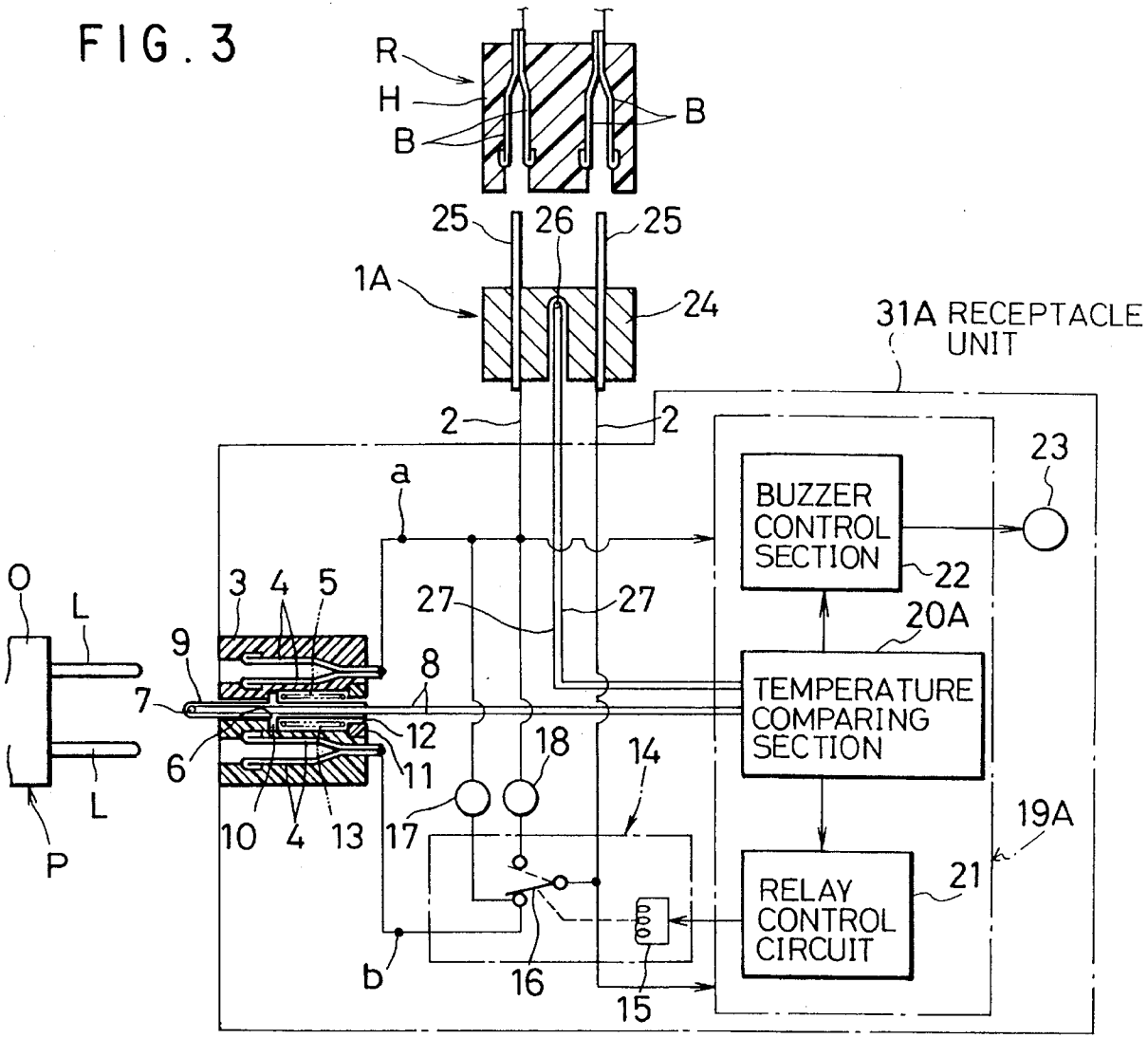
FIG. 3 is a schematic diagram showing the configuration of a receptacle unit according to a second aspect of the invention.

FIG. 3 is a schematic diagram showing the configuration of a receptacle unit 31A according to a second aspect of the invention. Members designated by the same reference symbols as those in FIGS. 1 and 2 are the same as those in FIG. 1 and 2 and will not be explained again.

Reference symbol R in FIG. 3 designates an electric power source receptacle that is part of a wall outlet or the like. It is constituted of a case H made of a resin that is an electrical insulator and a pair of slotted terminals B housed therein.

Reference symbol 1A designates a source-side electrical plug constituted of a plug case 24 made of a resin that is an electrical insulator and a pair of blades 25 formed to project from the plug case 24 and intended for insertion into the slotted terminals B of the receptacle R. The blades 25 are connected to slotted terminals 4 and a control circuit 19A through a cord 2.

A thermistor 26 serving as a first temperature sensor is embedded in the plug case 24 so as to be able to detect the temperature of the opposing surface of the case H when the source-side plug 1A is plugged into the receptacle R, and is connected with a temperature comparing section 20A of the control circuit 19A by lead wires 27.

A thermistor 7 serving as a second temperature sensor is connected with the temperature comparing section 20A of the control circuit 19A by lead wires 8.

The armature 16 of a relay 14 is positioned to supply power from the plug 1A to the slotted terminals 4 when no current is passing through a coil 15 and switches to cut off the supply of power from the plug 1A to the slotted terminals 4 when current is passed through the coil 15.

A green lamp 17 lights to indicate normal operation when power is being supplied from the plug 1A to the slotted terminals 4. The green lamp 17 goes of and a red lamp 18 lights to indicate abnormal operation when the supply of power from the plug 1A to the slotted terminals 4 is cut off.

The control circuit 19A comprises the temperature comparing section 20A, a relay control section 21 and a buzzer control section 22. The temperature comparing section 20A compares the temperature detected by the thermistor 26 with a first preset temperature, e.g., 120° C. if the receptacle unit is 15 A, and outputs a normal temperature signal or an abnormal temperature signal depending on whether or not the detected temperature is below the first preset temperature, and further compares the temperature detected by the thermistor 7 with a second preset temperature, e.g., 100° C., and outputs a normal temperature signal or an abnormal temperature signal depending on whether or not the detected temperature is below the second preset temperature. The relay control section 21 responds to an abnormal temperature signal from the temperature comparing section 20A by energizing the coil 15 of the relay 14. The buzzer control section 22 responds to an abnormal temperature signal from the temperature comparing section 20A by activating a buzzer 23.

Figure 4:
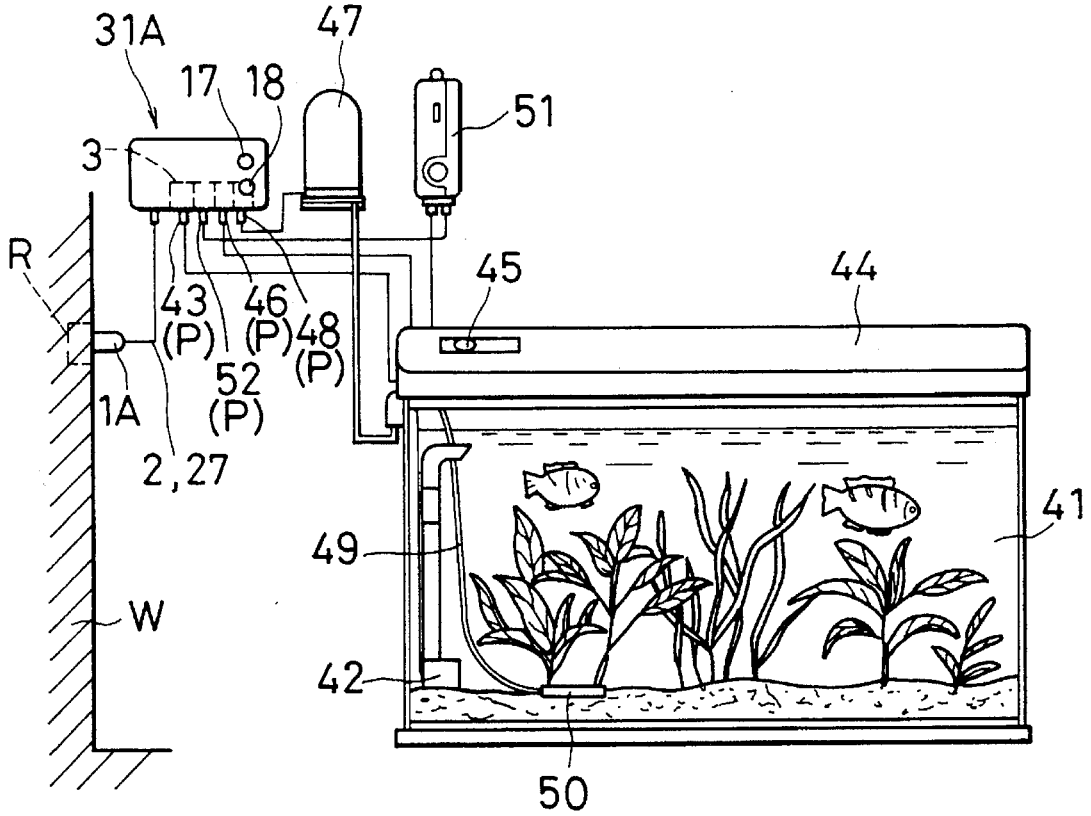
FIG. 4 is an explanatory view showing the receptacle unit according to the second aspect of the invention in use.

FIG. 4 is an explanatory view showing the receptacle unit 31A according to the second aspect of the invention in use. Members designated by the same reference symbols as those in FIGS. 1–3 are the same as those in FIGS. 1–3 and will not be explained again.

Since the receptacle unit 31A shown in FIG. 4 is adapted for insertion of four load-side plugs P, it is equipped with four of the receptacle bodies 3 shown in FIG. 3, each having a pair of slotted terminals 4 and a thermistor 7 encased in a protective tube 9.

The operation of the arrangement will now be explained.

If during the supply of power from the source receptacle R through the receptacle unit 31A to the different devices, the temperature of the plug case 24 between the blades 25 remains below the first preset temperature of the temperature comparing section 20A, the temperature detected by the thermistor 26 also stays below the first preset temperature, and if the temperature of the portion of the plug cases O of the plugs 43, 46, 48 and 52 between the blades L remains below the second preset temperature of the temperature comparing section 20A, the temperature detected by the thermistors 7 in the protective tubes 9 is also below the second preset temperature, so that the temperature comparing section 20A outputs a normal temperature signal. Since the relay control section 21 therefore does not energize the coil 15, the armature 16 remains in position of the solid line in FIG. 3 and the green lamp 17 stays lit.

Thus the fact that the green lamp 17 is lit means that the temperatures of the plug cases 24 and O, the receptacle bodies 3 and the receptacle case H are below the relevant first and second preset temperatures.

After the green lamp 17 has been on for some time, if the temperature of the plug case 24 should rise and reach or exceed the first preset temperature owing to the occurrence of tracking or overload, the temperature detected by the thermistor 26 also reaches or exceeds the first preset temperature. On the other hand, if the plug case O of the plug 46, for example, should rise and reach or exceed the second preset temperature owing to the occurrence of tracking or overload, the temperature detected by the thermistor 7 also reaches or exceeds the preset temperature. Since in either case the temperature comparing section 20A outputs an abnormal temperature signal, the relay control section 21 energizes the coil 15 and causes the armature 16 to switch to the position of the dashed line in FIG. 3.

As a result, the supply of power to the plugs 43, 46, 48 and 52 is cut off and the red lamp 18 lights to indicate that the temperature has risen owing to tracking or overload.

Since the buzzer control section 22 is also supplied with the abnormal temperature signal, it activates the buzzer 23 to issue a warning that tracking or overload has occurred.

Since according to the second aspect of the invention the thermistor 26 is embedded in the plug case 24 and the thermistor 7 encased in the protective tube 9 is disposed in the receptacle body 3, adequate space is available for the provision of the thermistors 26 and 7.

In addition, the thermistor 26 is protected from damage by being embedded in the plug case 24 and the thermistor 7 is protected from damage by being encased in the tube 9.

Further, since the thermistor 26 is embedded in the plug case 24, it can reliably detect the temperature of the plug case 24.

On the other hand, the temperature of the plugs P (plugs 43, 46, 48 and 52) can be reliably detected even if their blades L are not fully inserted since the coil springs 13 project the protective tubes 9 out from the receptacle body 3 so as to ensure that the thermistors 7 are kept substantially in contact with the plugs 43, 46, 48 and 52.

When the temperature of the plug case 24 or any of the plugs P rises to or above the relevant preset temperature because of tracking or overload, moreover, the control circuit 19A operates the relay 14 to cut off the supply of power to the plugs 43, 46, 48 and 52 and sounds the buzzer 23 as a warning that tracking or overload has occurred.

When tracking or overload occurs, therefore, appropriate corrective action can be promptly taken. In addition, since the supply of power to the loads is cut off, the temperature between the blades 25 or blades L of the plugs 1A and P (plugs 43, 46, 48 and 52) and between the slotted terminals 4 of the receptacle bodies 3 falls, so that the plugs 1A, 43, 46, 48 and 52 and receptacle bodies 3 can be prevented from burning.

Figure 5A:
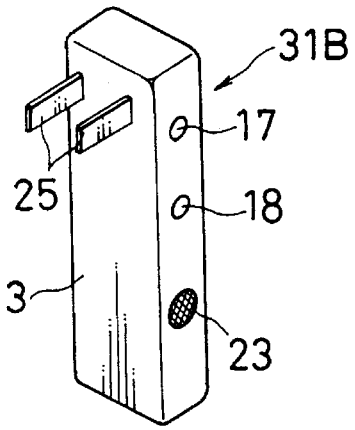
FIG. 5(*a*) is a perspective view showing a receptacle unit according a third aspect of the invention seen from the side of its blades.
Figure 5B:
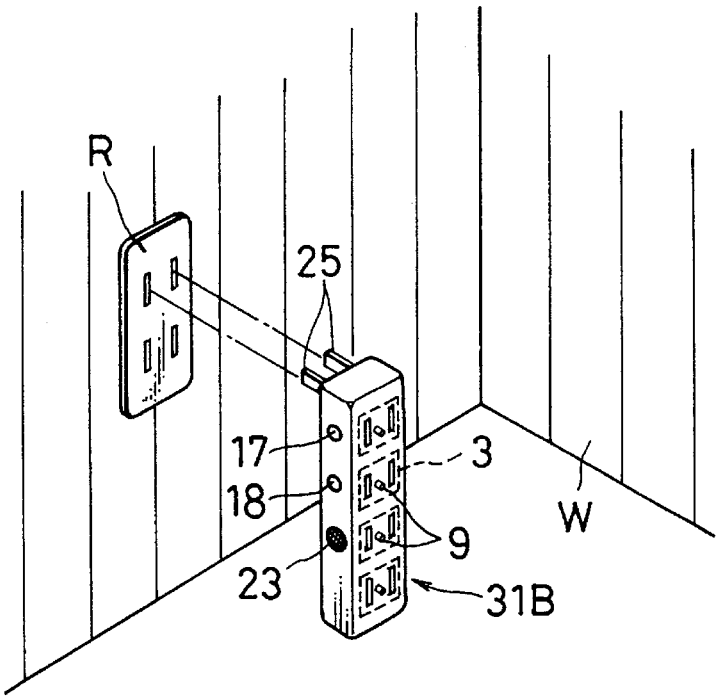

FIG. 5(*a*) is perspective views showing a receptacle unit 31B according a third aspect of the invention seen from the side of its blades and FIG. 5(*b*) is a perspective view of the same seen from the side of its slotted terminals. Members designated by the same reference symbols as those in FIGS. 3 and 4 are the same as those in FIGS. 3 and 4 and will not be explained again.

The receptacle unit 31B is constituted by integrating the source-side plug 1A of the receptacle unit 31A according to the second aspect of the invention with a unitary receptacle body 3 for multiple receptacles.

The operation, function and effect of the receptacle unit 31B according to the third aspect of the invention are the same as those of the receptacle unit 31A according to second aspect of the invention and will not be explained further here.

It is also possible to integrate the source-side plug 1 of the receptacle unit 31 according to the first aspect of the invention with a unitary receptacle body 3 for multiple receptacles.

Figure 6:
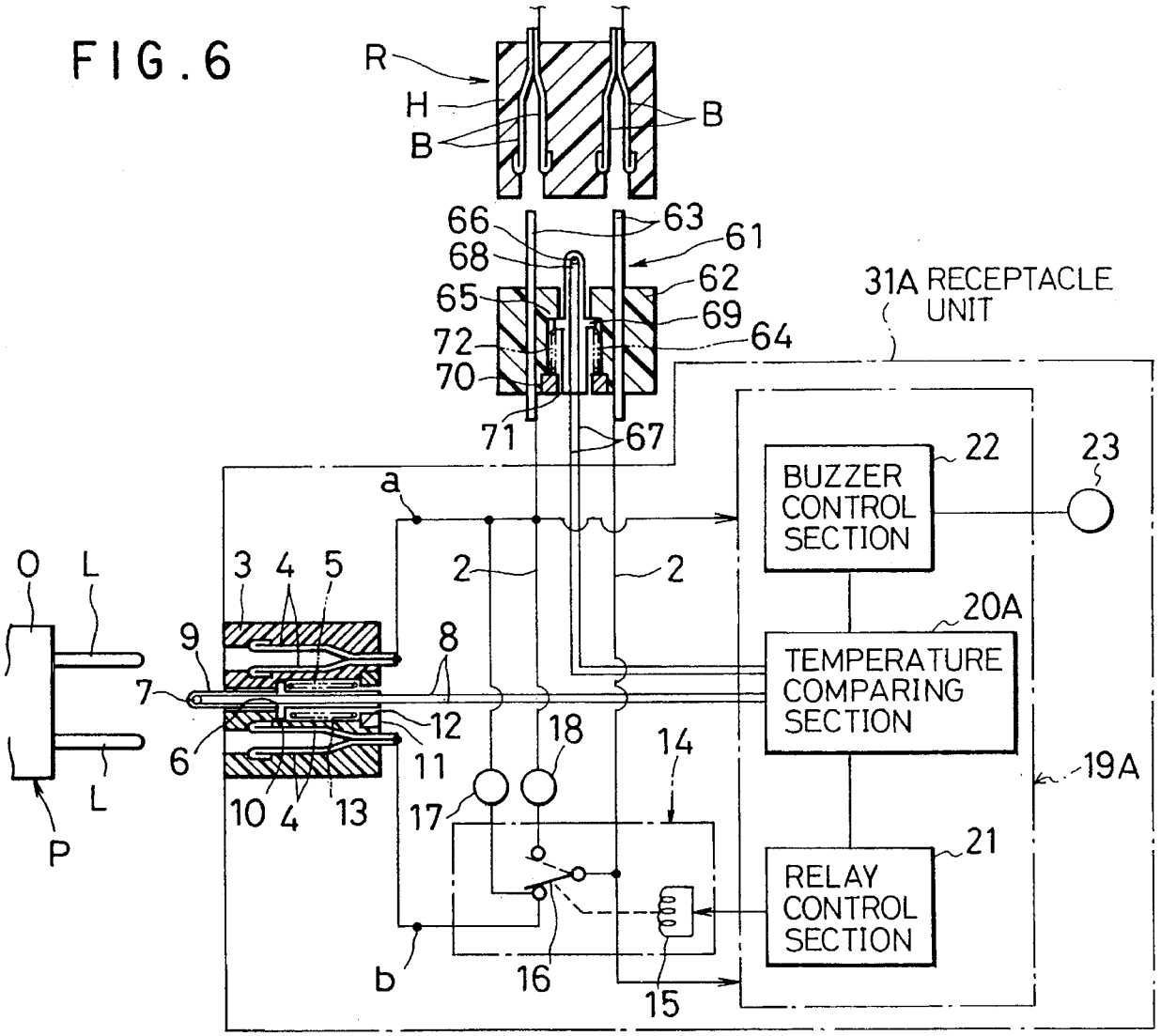
FIG. 6 is a schematic diagram showing the configuration of a receptacle unit according to a fourth aspect of the invention.

FIG. 6 is a schematic diagram showing the configuration of a receptacle 31A according to a fourth aspect of the invention. Members designated by the same reference symbols as those in FIG. 3 are the same as those in FIG. 3 and will not be explained again.

Reference numeral 61 in FIG. 6 designates a source-side plug comprising a plug case 62 made of a resin that is an electrical insulator, a pair of blades 63 formed to project from the plug case 62 and intended for insertion into slotted terminals B of a receptacle R, and a thermistor 66, protective tube 68, stop 70 and coil spring 72 explained below. The blades 63 are connected to slotted terminals 4 and a control circuit 19A through a cord 2.

The plug case 62 is formed between the blades 63 with a through hole 64 having a step 65, and the protective tube 68 having the thermistor 66 sealed therein is disposed in the through hole 64 with a flange 69 thereof abutting on the step 65.

The thermistor 66, which serves as a first temperature sensor, is connected to a temperature comparing section 20A of the control circuit 19A by lead wires 67.

A stop 70 is fixed by welding or screw engagement in the rear end of the through hole 64 of the plug case 62. The stop 70 has a central through hole 71 through which the protective tube 68 can advance and retreat.

The coil spring 72 is inserted between the flange 69 of the protective tube 68 and the stop 70 for pressing the flange 69 in contact with the step 65 of the through hole 64. When the flange 69 of the protective tube 68 is in contact with the step 65 of the through hole 64, the tip of the protective tube 68 projects about 7 mm out of the plug case 62.

The operation and function of the receptacle unit 31A according to the fourth aspect of the invention are the same as those of the receptacle unit 31A according to second aspect of the invention and will not be explained further here.

Since according to the fourth aspect of the invention the thermistor 66 encased in the protective tube 68 is disposed in the plug case 62 and the thermistor 7 encased in the protective tube 9 is disposed in the receptacle body 3, adequate space is available for the provision of the thermistors 66 and 7.

In addition, the thermistor 66 is protected from damage by being encased in the protective tube 68 and the thermistor 7 is protected from damage by being encased in the tube 9.

Further, the temperatures of the source receptacle R and the load-side plug P can be reliably detected even if the blades 63, L are not fully inserted since the coil spring 72 projects the protective tube 68 out from the plug case 62 and the coil spring 13 projects the protective tube 9 out from the receptacle body 3, thereby ensuring that the thermistors 66, 7 are kept substantially in contact with the source receptacle R and the plug P as separated therefrom only by the protective tubes 68, 9.

When the temperature of the source-side plug 61, the source receptacle R or any of the load-side plugs P rises to or above the relevant first or second preset temperature because of tracking or overload, moreover, the control circuit 19A operates the relay 14 to cut off the supply of power to the plugs P and sounds the buzzer 23 as a warning that tracking or overload has occurred.

When tracking or overload occurs, therefore, appropriate corrective action can be promptly taken. In addition, since the supply of power to the loads is cut off, the temperature between the blades 63 or blades L of the plugs 61, P and between the slotted terminals 4 of the receptacle bodies 3 falls, so that the plugs 61 and P, the receptacle bodies 3 and the case H of the source receptacle R can be prevented from burning.

It is also possible to integrate the source-side plug 61 of the receptacle unit 31A according to the fourth aspect of the invention with a unitary receptacle body 3 for multiple receptacles, in the manner illustrated in FIG. 5.

Figure 7:
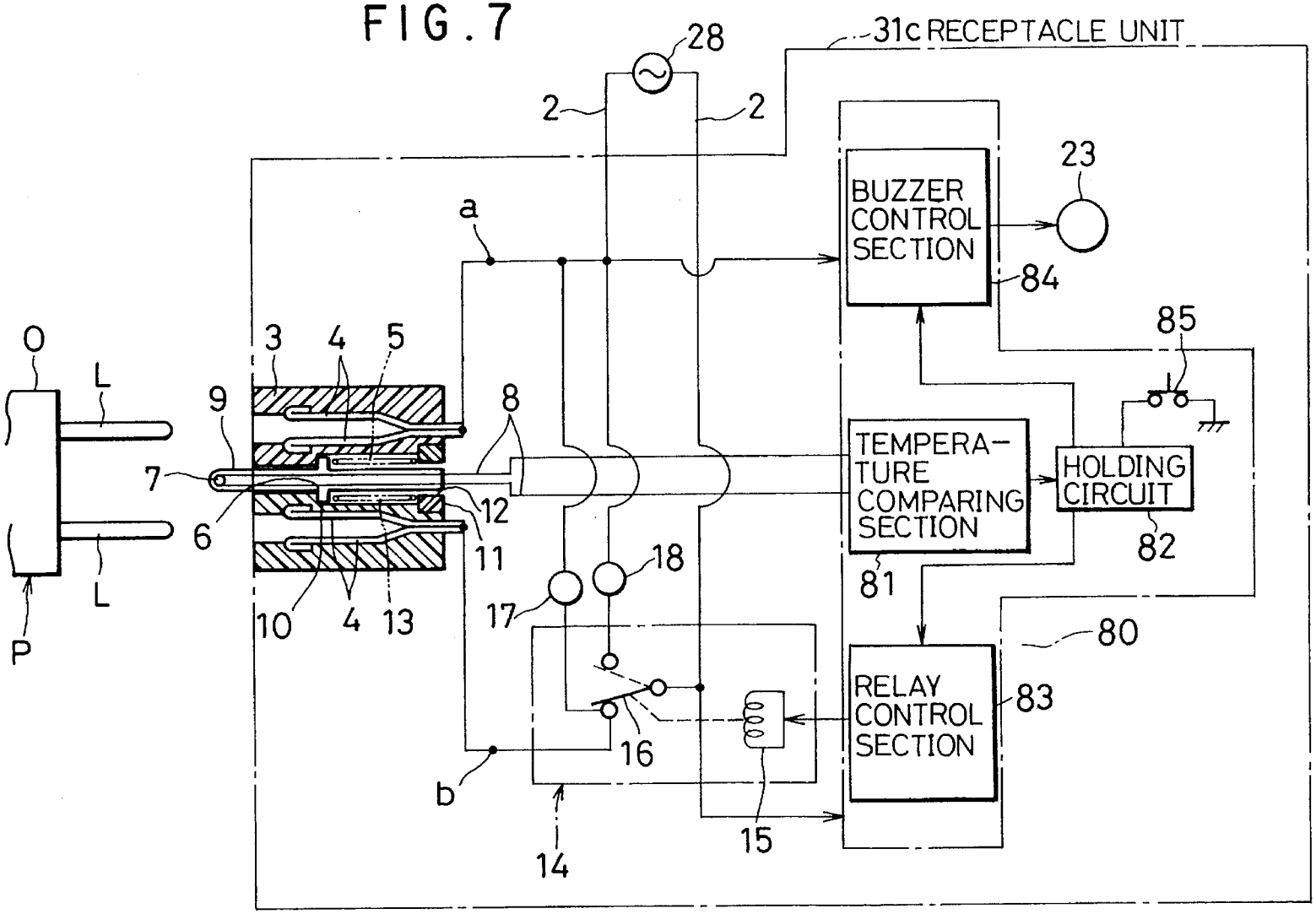
FIG. 7 is a schematic diagram showing the configuration of a receptacle unit according to a fifth aspect of the invention.
Figure 8:
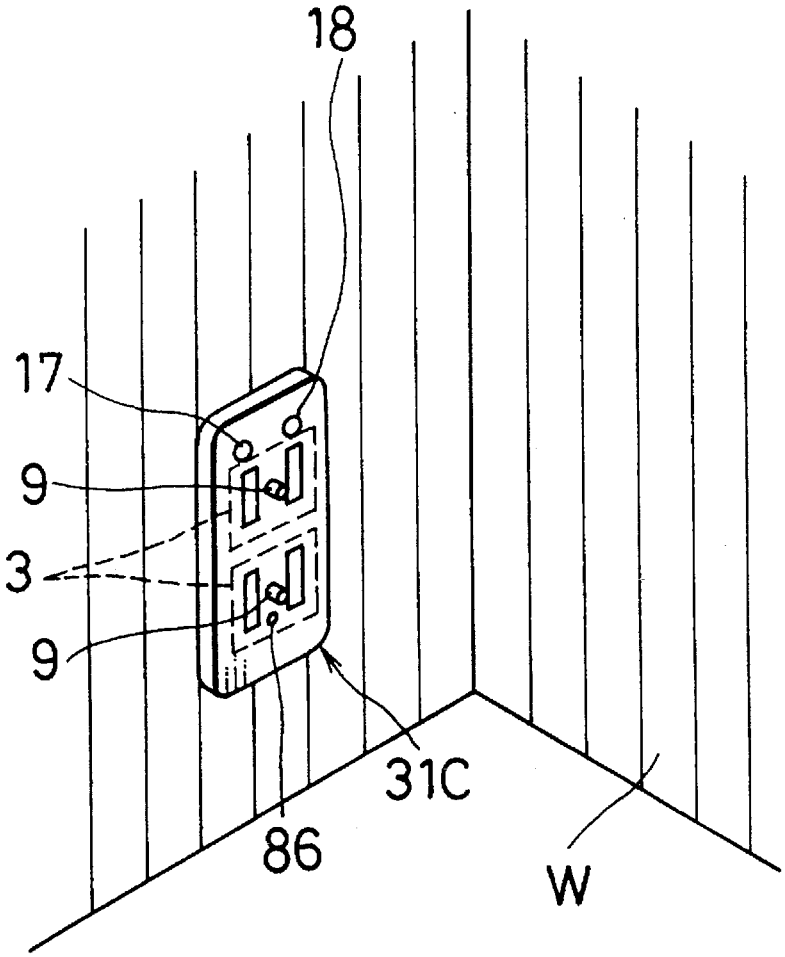
FIG. 8 is a perspective view showing the receptacle unit according to the fifth aspect of the invention installed in a wall.

FIG. 7 is a schematic diagram showing the configuration of a receptacle unit 31C according to a fifth aspect of the invention and FIG. 8 is a perspective view showing the receptacle unit according to the fifth aspect of the invention installed in a wall. Members designated by the same reference symbols as those in FIGS. 1–6 are the same as those in FIGS. 1–6 and will not be explained again.

In these figures, reference numeral 28 designates an AC power source, e.g., an AC branch line from the wiring in the building in which the receptacle unit 31C is used. The receptacle unit 31C is installed in a wall W of the building and is supplied with power from the AC power source 28 through a cord 2.

The receptacle unit 31C has a control circuit 80 comprising a temperature comparing section 81, a holding circuit 82, a relay control section 83, a buzzer control section 84, and reset switch 85. The temperature comparing section 81 compares the temperature detected by a thermistor 7 with a preset temperature, e.g., 100° C., and outputs a normal temperature signal or an abnormal temperature signal depending on whether or not the detected temperature is below the preset temperature. The holding circuit 82 holds the output of the temperature comparing section 81. The relay control section 83 responds to an abnormal temperature signal from the holding circuit 82 by energizing the coil 15 of a relay 14. The buzzer control section 84 responds to an abnormal temperature signal from the temperature comparing section 81 by activating a buzzer 23, and the reset switch 85 operates as a means for clearing the hold state of the holding circuit 82, enabling supply of power to the load-side plug P and restoring the buzzer 23 to its inactivated state.

The difference in the operation of the receptacle unit 31C from that of the receptacle units according to the other aspects of the invention will now be explained.

In this aspect of the invention, the slotted terminals 4 of the receptacle body 3 are hard-wired to the AC power source 28 to be constantly applied with AC voltage so long as the operation remains normal.

When no tracking or overload has occurred, the temperature detected by the thermistor 7 is below the preset temperature, the temperature comparing section 81 outputs a normal temperature signal to the holding circuit 82, and the holding circuit 82 outputs normal temperature signals to the relay control section 83 and the buzzer control section 84. As a result, the relay control section 83 does not energize the coil 15, the armature 16 remains in position of the solid line in FIG. 7, the green lamp 17 stays lit, and power is supplied to the load-side plug P.

If the temperature detected by the thermistor 7 should rise to or above the preset temperature owing to the occurrence of tracking or overload, however, the temperature comparing section 81 outputs an abnormal temperature signal to the holding circuit 82 and the holding circuit 82 outputs abnormal temperature signals to the relay control section 83 and the buzzer control section 84. As a result, the relay control section 83 energizes the coil 15 and causes the armature 16 to switch to the position of the dashed line in FIG. 7, whereby the supply of power to the plug P is cut off and the red lamp 18 is lit to indicate that tracking or overload has occurred.

Since the buzzer control section 84 is also supplied with the abnormal temperature signal, it activates the buzzer 23 to issue a warning that tracking or overload has occurred.

After corrective action has been taken to eliminate the tracking or overload, the reset switch 85 of the control circuit 80 is operated to clear the hold state of the holding circuit 82, thereby enabling supply of power to the plug P and restoring the buzzer 23 to its inactivated state.

The receptacle unit 31B according to the fifth aspect of the invention is provided with the reset switch 85 because it is built into the wall W and its control circuit 80 cannot easily be reset by cutting of the power supply from the power source as is possible in the case of the control circuit 19 or 19A of the receptacle units according to the aspects of the invention described earlier.

The holding circuit 82 and the reset switch 85 can be constituted in any of various well-known ways. For example, the holding circuit 82 can be a two-state circuit such as a reset-set flip-flop whose reset terminal is supplied with a ground-potential signal as negative logic when the reset switch 85 is turned on.

The provision of such a reset means simplifies the operation of resetting the receptacle unit after a tracking or overload problem has been corrected since it eliminates the troublesome work that would otherwise be required to disconnect the receptacle unit from the AC power source.

To prevent tampering, the reset switch 85 can be made to be operable only by inserting a toothpick or the like through a small hole 86 formed the receptacle body 3.

While the receptacle unit 31C was described as being installed in the wall W, it can be modified for use in other ways by, for example, converting the AC power source 28 to an ordinary plug or a plug integrated with the receptacle body 3.

Figure 9:
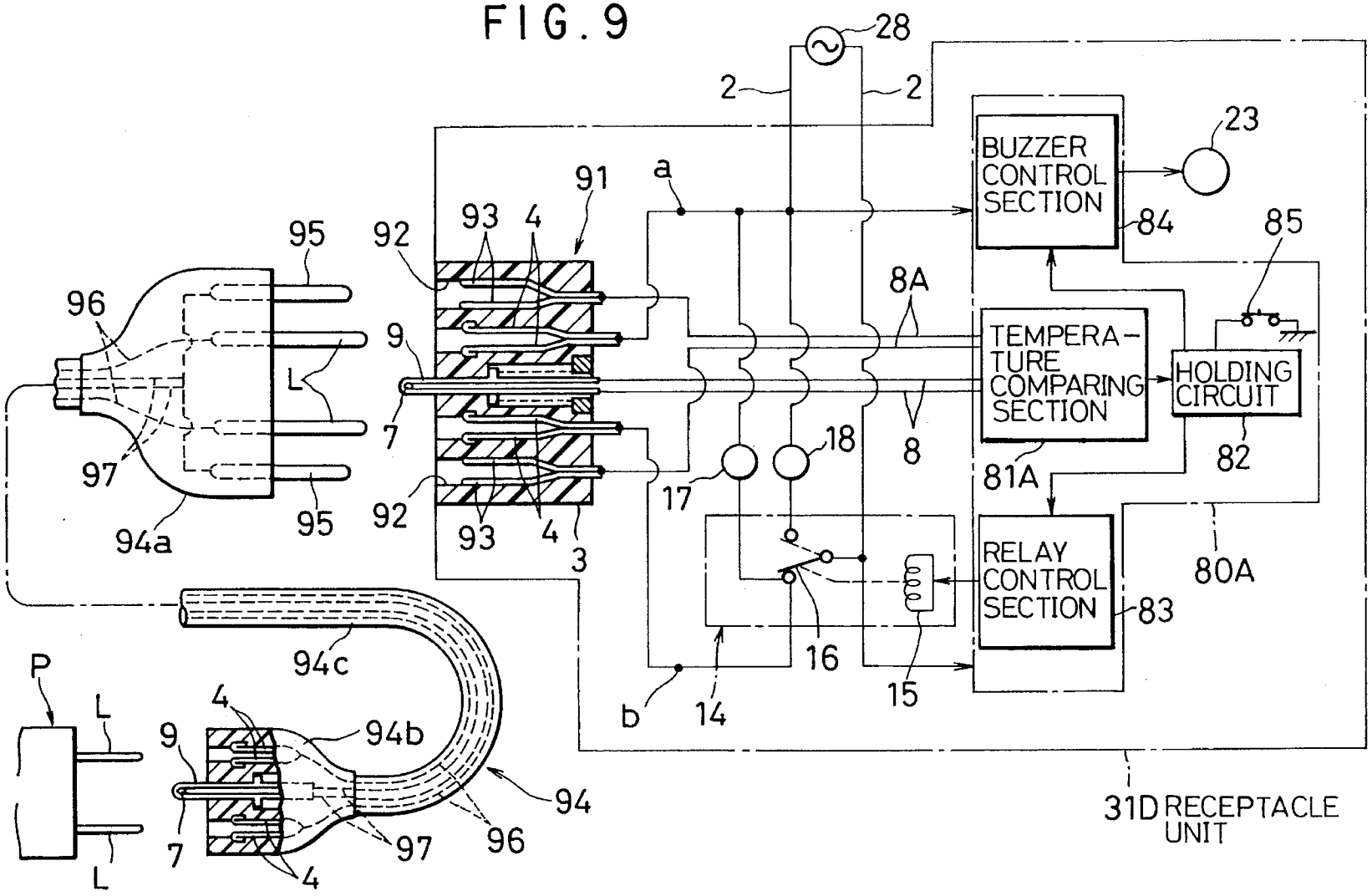
FIG. 9 is a schematic diagram showing the configuration of a receptacle unit and an extension cord according to a sixth aspect of the invention.

FIG. 9 is a schematic diagram showing the configuration of a receptacle unit 31D and an extension cord 94 according to a sixth aspect of the invention. Members designated by the same reference symbols as those in FIGS. 1–8 are the same as those in FIGS. 1–8 and will not be explained again.

The receptacle unit 31D shown in FIG. 9 has a control circuit 80A comprising a temperature comparing section 81A, a holding circuit 82, a relay control section 83, a buzzer control section 84, and reset switch 85. The temperature comparing section 81A receives a temperature signal from a thermistor 7 through lead wires 8 and a temperature signal from another a thermistor 7 through a pair of pin slots 93 and lead wires 8A (both described below) and compares the temperatures indicated by these temperature signals with a preset temperature, e.g., 100° C., and outputs a normal temperature signal or an abnormal temperature signal depending on whether or not the detected temperatures are below the preset temperature. The holding circuit 82 holds the output of the temperature comparing section 81A. The relay control section 83 responds to an abnormal temperature signal from the holding circuit 82 by energizing the coil 15 of a relay 14. The buzzer control section 84 responds to an abnormal temperature signal from the temperature comparing section 81 by activating a buzzer 23, and the reset switch 85 operates as a means for clearing the hold state of the holding circuit 82, enabling supply of power to the load-side plug P and restoring the buzzer 23 to its inactivated state.

The receptacle unit 31D is further provided with a receptacle body 91 incorporating a pair of slotted terminals 4 for insertion of a pair of blades L and a protective tube 9 encasing the thermistor 7, which serves as a temperature sensor. The protective tube 9 is biased by a coil spring to project out from the receptacle body 91.

The temperature signal produced by the thermistor 7 is supplied through lead wires 8 to the temperature comparing section 81A of the control circuit 80A, whereby the occurrence of tracking and overload can be detected in the manner explained earlier.

The receptacle body 91 also has the pair of slotted pin terminals 93, which are disposed in pin insert holes 92 to serve as temperature signal relay means. The slotted pin terminals 93 are connected through the lead wires 8A to the temperature comparing section 81A of the control circuit 80A, which uses the temperature signal supplied thereto via the slotted pin terminals 93 to conduct processing for detecting tracking and overload, cutting off the supply of power and producing an alarm.

The extension cord 94 is for conducting power from the receptacle unit 31D to the plug P at a location remote from receptacle unit 31D. It comprises an extension plug **94*a*, an extension receptacle 94*b* and a cable 94*c* connecting the extension plug 94*a* and the extension receptacle 94*b***.

The extension plug **94*a* has the pair of blades L and a pair of pins 95 insertable into the pin insert holes 92 of the receptacle body 91** to serve as temperature signal relay means.

The extension receptacle **94*b* has a pair of slotted terminals 4 for receiving a pair of blades L, and a thermistor 7 serving as a temperature sensor is disposed between slotted terminals 4 and energized by a spring or the like to project out from the extension receptacle 94*b***.

The cable **94*c* includes power wires 96 which connect the slotted terminals 4 of the extension receptacle 94*b* with the blades L of the extension plug 94*a* and signal wires 97 which connect the thermistor 7 of the extension receptacle 94*b* with the pins 95 of the extension plug 94*a***.

Therefore, when the extension cord 94 is plugged into the receptacle body 91 and the blades L of a load-side plug P are inserted into the slotted terminals 4 of the extension receptacle **94*b* of the extension cord 94, the thermistor 7 of the extension receptacle 94*b* is pushed inward against the force of the spring while maintaining contact with the part of the plug P between the blades L. If the temperature of the extension receptacle 94*b* or the portion of the plug case O of the plug P between the slotted terminals 4 overheats owing to the occurrence of tracking or overload, the thermistor 7 provided in the extension receptacle 94*b* detects the temperature rise and sends a corresponding signal to the temperature comparing section 81A through the signal wires 97 of the cable 94*c*, the pins 95 of the extension plug 94*a*, the slotted pin terminals 93 of the receptacle body 91 and the lead wires 8A**.

Thus even though the extension cord 94 itself is not provided with tracking and overload occurrence detection capability and is not equipped with means for cutting off the supply of power and producing an alarm when tracking or overload is detected, it is nevertheless possible to detect the occurrence of tracking and overload and to cut off the supply of power by utilizing the capability on the side of the receptacle unit 31D.

Since the temperature sensors used are thermistors or other such devices whose resistance varies with temperature, the temperature signals produced by the temperature sensors have to be separately supplied to the temperature comparing section 81A. If the extension cord 94 is to be replaced by a table tap or another extension cord is to be connected with therewith, it is necessary to provide as many pairs of temperature signal wires and temperature signal relay means as there are temperature sensors. For example, to configure a table tap with four receptacles, it is necessary to provide four pairs of temperature signal wires for carrying the signals from the temperature sensors of the receptacles to the plug, four pairs of temperature signal relay means in the plug corresponding to the four pairs of temperature signal wires, and four pairs of temperature signal relay means in the receptacle body connectable with the four pairs of temperature signal relay means in the plug.

Although the receptacle unit 31D according to the sixth aspect of the invention shown in FIG. 9 has both temperature relay means and a temperature sensor provided in the receptacle body 91, other arrangements are also possible. For example, the receptacle body 91 can be provided with only the temperature signal relay means.

While the receptacle unit 31D is designed for installation in a wall, it can be modified for use in other ways by, for example, converting the AC power source 28 to an ordinary plug or a plug integrated with the receptacle body.

Figure 10:
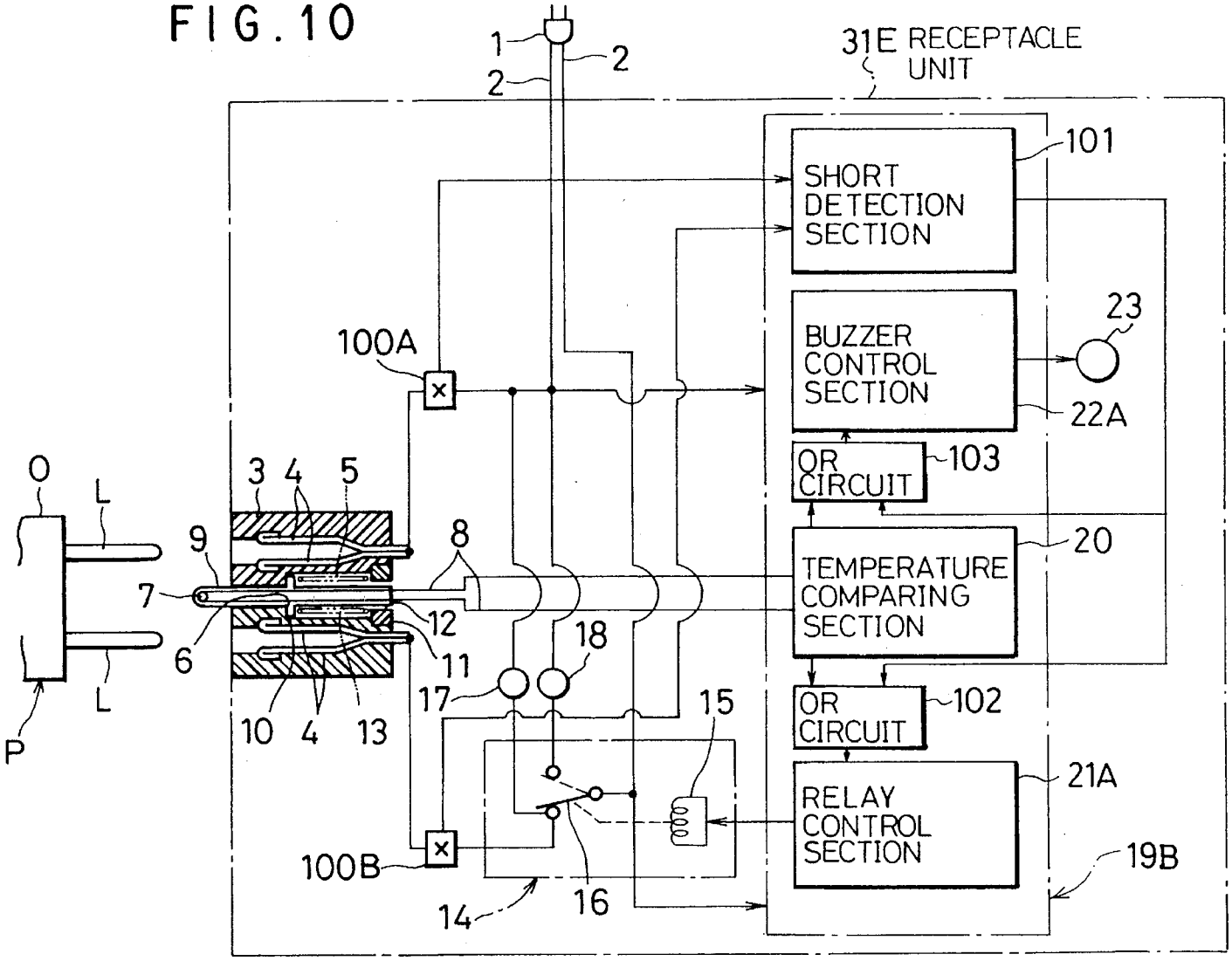
FIG. 10 is a schematic diagram showing the configuration of a receptacle unit according to a seventh aspect of the invention.

FIG. 10 is a schematic diagram showing the configuration of a receptacle unit 31E according to a seventh aspect of the invention. This seventh aspect of the invention is a modification on the first aspect shown in FIG. 1. Members designated by the same reference symbols as those in FIG. 1 are the same as those in FIG. 1 and will not be explained again.

As shown in FIG. 10, the receptacle unit 31E has a control circuit 19B comprising a temperature comparing section 20, an OR circuit 102, a relay control section 21A, an OR circuit 103, a buzzer control section 22A, and a short current detection section 101. The temperature comparing section 20 compares the temperature detected by a thermistor 7 with a preset temperature, e.g., 100° C., and outputs a normal temperature signal or an abnormal temperature signal depending on whether or not the detected temperature is below the preset temperature. The OR circuit 102 outputs the signal supplied thereto when supplied with an abnormal temperature signal from the temperature comparing section 20 and/or a short signal from the short detection section 101. The relay control section 21A responds to an abnormal temperature signal and/or a short signal from the OR circuit 102 by energizing the coil 15 of a relay 14. The OR circuit 103 outputs the signal supplied thereto when supplied with an abnormal temperature signal from the temperature comparing section 20 and/or a short signal from the short detection section 101. The buzzer control section 22A responds to an abnormal temperature signal and/or a short signal from the OR circuit 103 by activating a buzzer 23. The short detection section 101 detects the occurrence of a short based on a signal received from a short current detector (a single detector by indicated in two parts 100A, 100B as explained below) and outputs a short signal when a short is detected.

The short current detector is inserted in the wires of the cord 2 between the source-side plug 1 and the slotted terminals 4 for detecting short current in a circuit powered through the blades of the load-side plug inserted in the slotted terminals 4 of the receptacle body. Since the wires of the cord 2 appear separated in FIG. 10, the short current detector is indicated as divided into two parts 100A and 100B but is actually a single unit. When no short current is present it produces no output because the same amount of current flows in both directions and no voltage is induced. When short current is present, however, it produce a short signal based on the voltage induced by the resulting difference in the amount of current flowing in opposite directions. It can be constituted using a zero phase current transformer.

The difference in the operation of the receptacle unit 31E from that of the receptacle units according to the other aspects of the invention will now be explained.

When a short occurs in a load circuit powered through the slotted terminals 4, the short current detector 100A, 100B applies a prescribed voltage to the short detection section 101 which responds by sending short signals to the OR circuits 102, 103.

Similarly to in the case of the detection of tracking or overload, therefore, the receptacle unit 31E also responds to the detection of shorting by cutting off the supply of power to points downline from the slotted terminals 4 and sounds the buzzer 23 as a warning that a malfunction has arisen. As a result, fire and other risks from faulty electrical operation can be prevented and the user can be alerted to the need for corrective action.

The receptacle units according to the second to sixth aspects of the invention can also be provided with this function of the seventh aspect by adding a short current detector 100A, 100B at the points marked a and b in FIGS. 3, 6, 7 and 9, a short detection section 101 for receiving the output of the short current detector 100A, 100B, and OR circuits 102, 103 for supplying the output of the short detection section 101 to the relay control section 21, 83 and the buzzer control section 22, 84 or to the holding circuit 82.

It is also possible to omit the OR circuits from these configurations.

While the receptacle units according to the different aspects of the invention were described with respect the case where the protective tube 9 is projected 7 mm from the receptacle body 3 and the protective tube 68 is projected 7 mm from the plug case 62, other arrangements are also possible. Specifically, contact between the tip of the protective tube 68, 9 and the case H, O at the time of inserting the plug 61, P into the receptacle R or the receptacle body 3, 91 is ensured so long as the protective tube 9, 68 projects by a distance in the range of 1/10 to ½ the length of the exposed portion of the blades 63, L of the plug 61, P. Since the exposed portion of the blades 63, L of a plug 61, P for home use measures around 18 mm, it suffices for the protective tube 68, 9 to project from the plug case 62 or the receptacle body 3 by between 1.8 mm and 9 mm.

A shorter amount of projection of the protective tube 68, 9 within this range provides better protection for both the protective tube 68, 9 and the thermistor 66, 7 encased therein.

Although examples in which the thermistors 26, 66, 7 were used as the first and second temperature sensors were described, this is not limitative and it is also possible to use any other type of device capable of producing an output which changes with temperature.

Although examples in which the thermistors 26, 66, 7 were encased in protective tubes 68, 9 were described, this is not limitative and the first and second temperature sensors can be left unprotected by the protective tubes 68, 9 if the conditions so permit and the amount of projection thereof is between 1/10 and ½ the length of the exposed portion of the blades 63, L.

Although examples in which the relay 14 was used as the switching circuit were described, this is not limitative and a semiconductor or other type switch can be used instead.

Although examples in which the buzzer 23 was used as the alarm were described, this is not limitative and any other type of alarm capable of producing a warning can be used instead.

Although examples in which the first preset temperature was 120° C. and the second preset temperature was 100° C. were explained, this is not limitative and the preset temperatures can (should preferably) be set in light of the rated current of the receptacle unit to values that are lower than the ignition points of the cases H, 24, 62, O and the receptacle body 3.

In the first aspect of the invention, the receptacle unit can be constituted of only the receptacle body 3, the slotted terminals 4, the thermistor 7 and the coil spring 13.

In the second aspect of the invention, the receptacle unit can be constituted of only the receptacle body 3, the slotted terminals 4, the thermistor 7, the coil spring 13, and the source-side plug 1A.

Since the invention disposes the temperature sensor in the receptacle body, adequate space is available for the provision of the temperature sensor.

Since the temperature sensor is projected from the receptacle body by an energizing member, the temperature of the plug can be reliably detected even if its blades are not fully inserted since the energizing member projects the temperature sensor out from the receptacle body so as to ensure that it is kept substantially in contact with the plug, whereby tracking and overload can be determined from the detected temperature and the user be alerted to the need for corrective action.

Since the control circuit operates the switching circuit to cut off the supply of power to the load-side plug when its temperature rises to or above the preset temperature because of tracking or overload, the supply of power to the plug can be cut off before it starts to burn owing to overheating of the portion of contact between the receptacle body and the plug.

Since the control circuit sounds the alarm when the temperature of the plug rises to or above the preset temperature because of tracking or overload, the user is alerted that the plug temperature has exceeded the preset temperature and can take appropriate corrective action.

The operation for turning off the alarm and restoring the supply of power can be simplified by providing reset means for terminating the operation of the control circuit.

The provision of the reset means makes it easy to restore the operation.

Since supply of power to the load-side plug is cut off when a short is detected, fire and other risks from faulty electrical operation can be prevented and the user can be alerted to the need for corrective action.

By using an extension cord which carries detected temperature signals to the receptacle, it becomes possible to detect tracking and overload occurring between the receptacle and the load and to alert the user to the need for corrective action.

What is claimed is:

1. An electrical receptacle unit comprising:

at least one receptacle body internally provided with a pair of slotted terminals for insertion of a pair of blades of a load-side electrical plug, a temperature sensor outwardly projectable from between the slotted terminals of the receptacle body, and a biasing member for projecting the temperature sensor out from the receptacle body.

2. An electrical receptacle unit according to claim 1, further comprising a source-side electrical plug for receiving electric power from an electric power source receptacle.

3. An electrical receptacle unit according to claim 1, wherein the electrical receptacle unit is installed in a wall of a building and the slotted terminals of the receptacle body are supplied with electric power directly from electric wiring in the building.

4. An electrical receptacle unit according to claim 1, further comprising a switching circuit for enabling and disabling supply of electric power to the slotted terminals and a control circuit responsive to a temperature signal from the temperature sensor for operating the switching circuit to cut off supply of electric power to the slotted terminals when the temperature signal indicates a temperature equal to or higher than a preset temperature.

5. An electrical receptacle unit according to claim 4, further comprising reset means for terminating operation of the control circuit.

6. An electrical receptacle unit according to claim 4, further comprising an alarm which operates in response to an output signal produced by the control circuit when the temperature signal from the temperature sensor is equal to or higher than the preset temperature.

7. An electrical receptacle unit according to claim 6, further comprising a short current detector which sends a short signal to the control circuit in response to detection of short current in a circuit powered through the load-side electrical plug inserted in the receptacle body, the control circuit being responsive to the short signal for operating the switching circuit to cut off supply of electric power to the slotted terminals and for operating the alarm.

8. An electrical receptacle unit according to claim 4, further comprising a short current detector which sends a short signal to the control circuit in response to detection of short current in a circuit powered through the load-side electrical plug inserted in the receptacle body, the control circuit being responsive to the short signal for operating the switching circuit to cut off supply of electric power to the slotted terminals.

9. An electrical receptacle unit comprising:

a source-side electrical plug having a plug case and a pair of blades projecting from the plug case for insertion into a pair of slotted terminals of an electric power source receptacle, a first temperature sensor provided in the plug case for detecting temperature between the blades, at least one receptacle body internally provided with a pair of slotted terminals for insertion of a pair of blades of a load-side electrical plug, the receptacle body being connected to the source-side electrical plug through a cord, a second temperature sensor outwardly projectable from between the slotted terminals of the receptacle body, and a biasing member for projecting the second temperature sensor out from the receptacle body.

10. An electrical receptacle unit according to claim 9, further comprising a biasing member for projecting the first temperature sensor out from between the blades of the source-side electrical plug.

11. An electrical receptacle unit according to claim 9, wherein the source-side electrical plug is formed integrally with the receptacle body.

12. An electrical receptacle unit according to claim 9, further comprising a switching circuit for enabling and disabling supply of electric power to the slotted terminals and a control circuit responsive to a first temperature signal from the first temperature sensor and to a second temperature signal from the second temperature sensor for operating the switching circuit to cut off supply of electric power to the slotted terminals when the first temperature signal indicates a temperature equal to or higher than a first preset temperature or the second temperature signal indicates a temperature equal to or higher than a second preset temperature.

13. An electrical receptacle unit according to claim 12, further comprising an alarm which operates in response to an output signal produced by the control circuit when the first temperature signal indicates a temperature equal to or higher than the first preset temperature or the second temperature signal indicates a temperature equal to or higher than the second preset temperature.

14. An electrical receptacle unit according to claim 13, further comprising a short current detector which sends a short signal to the control circuit in response to detection of short current in a circuit powered through the load-side electrical plug inserted in the receptacle body, the control circuit being responsive to the short signal for operating the switching circuit to cut off supply of electric power to the slotted terminals and for operating the alarm.

15. An electrical receptacle unit according to claim 12, further comprising reset means for terminating operation of the control circuit.

16. An electrical receptacle unit according to claim 12, further comprising a short current detector which sends a short signal to the control circuit in response to detection of short current in a circuit powered through the load-side electrical plug inserted in the receptacle body, the control circuit being responsive to the short signal for operating the switching circuit to cut off supply of electric power to the slotted terminals.

17. An electrical receptacle unit comprising:

at least one receptacle body internally provided with a pair of slotted terminals for insertion of a pair of blades of a load-side electrical plug and temperature signal relay means for relaying a temperature signal supplied through the load-side electrical plug, a switching circuit for enabling and disabling supply of electric power to the slotted terminals, and a control circuit responsive to a temperature signal supplied through the temperature signal relay means for operating the switching circuit to cut off supply of electric power to the slotted terminals when the temperature signal indicates a temperature equal to or higher than a preset temperature.

18. An electrical receptacle unit according to claim 17, further comprising a temperature sensor outwardly projectable from between the slotted terminals of the receptacle body and a biasing member for projecting the temperature sensor out from the receptacle body, the control circuit being responsive to a temperature signal from the temperature sensor for operating the switching circuit to cut off supply of electric power to the slotted terminals when the temperature signal indicates a temperature equal to or higher than a preset temperature.

19. An electrical receptacle unit according to claim 17, further comprising a source-side electrical plug for receiving electric power from an electric power source receptacle.

20. An electrical receptacle unit according to claim 17, wherein the electrical receptacle unit is installed in a wall of a building and the slotted terminals are supplied with electric power directly from electric wiring in the building.

21. An electrical receptacle unit according to claim 17, further comprising reset means for terminating operation of the control circuit.

22. An electrical receptacle unit according to claim 17, further comprising an alarm which operates in response to an output signal produced by the control circuit when the temperature signal from the temperature sensor is equal to or higher than the preset temperature.

23. An electrical receptacle unit according to claim 22, further comprising a short current detector which sends a short signal to the control circuit in response to detection of short current in a circuit powered through the load-side electrical plug inserted in the receptacle body, the control circuit being responsive to the short signal for operating the switching circuit to cut off supply of electric power to the slotted terminals and for operating the alarm.

24. An electrical receptacle unit according to claim 17, further comprising a short current detector which sends a short signal to the control circuit in response to detection of short current in a circuit powered through the load-side electrical plug inserted in the receptacle body, the control circuit being responsive to the short signal for operating the switching circuit to cut off supply of electric power to the slotted terminals.

25. An electrical receptacle unit comprising:

a source-side electrical plug having a plug case and a pair of blades projecting from the plug case for insertion into a pair of slotted terminals of an electric power source receptacle, a first temperature sensor provided in the plug case for detecting temperature between the blades, at least one receptacle body internally provided with a pair of slotted terminals for insertion of a pair of blades of a load-side electrical plug and temperature signal relay means for relaying a temperature signal supplied through the load-side electrical plug, the receptacle body being connected to the source-side electrical plug through a cord, a switching circuit for enabling and disabling supply of electric power to the slotted terminals, and a control circuit responsive to a first temperature signal from the first temperature sensor and to a second temperature signal supplied through the temperature signal relay means for operating the switching circuit to cut off supply of electric power to the slotted terminals when the first temperature signal indicates a temperature equal to or higher than a first preset temperature or the second temperature signal indicates a temperature equal to or higher than a second preset temperature which is lower than the first preset temperature.

26. An electrical receptacle unit according to claim 25, further comprising a biasing member for projecting the first temperature sensor out from between the blades of the source-side electrical plug.

27. An electrical receptacle unit according to claim 25, further comprising a second temperature sensor outwardly projectable from between the slotted terminals of the receptacle body and a biasing member for projecting the second temperature sensor out from the receptacle body, the control circuit being responsive to a third temperature signal from the second temperature sensor for operating the switching circuit to cut off supply of electric power to the slotted terminals when the third temperature signal indicates a temperature equal to or higher than the second preset temperature.

28. An electrical receptacle unit according to claim 25, wherein the source-side electrical plug is formed integrally with the receptacle body.

29. An electrical receptacle unit according to claim 25, further comprising reset means for terminating operation of the control circuit.

30. An electrical receptacle unit according to claim 25, further comprising an alarm which operates in response to an output signal produced by the control circuit when the first temperature signal indicates a temperature equal to or higher than the first preset temperature or the second or third temperature signal indicates a temperature equal to or higher than the second preset temperature.

31. An electrical receptacle unit according to claim 30, further comprising a short current detector which sends a short signal to the control circuit in response to detection of short current in a circuit powered through the load-side electrical plug inserted in the receptacle body, the control circuit being responsive to the short signal for operating the switching circuit to cut off supply of electric power to the slotted terminals and for operating the alarm.

32. An electrical receptacle unit according to claim 25, further comprising a short current detector which sends a short signal to the control circuit in response to detection of short current in a circuit powered through the load-side electrical plug inserted in the receptacle body, the control circuit being responsive to the short signal for operating the switching circuit to cut off supply of electric power to the slotted terminals.

33. An electrical extension cord comprising:

an extension plug having a pair of blades for insertion into slotted terminals of an electrical receptacle and temperature signal relay means for contacting with temperature signal relay means of the electrical receptacle, an extension receptacle having a pair of slotted terminals, a temperature sensor outwardly projectable from between the slotted terminals and a biasing member for projecting the temperature sensor out from the extension receptacle, power wires connecting the slotted terminals of the extension receptacle to the blades of the extension plug, and signal wires connecting the temperature sensor to the temperature signal relay means.

* * * * *